US009890934B2

(12) United States Patent
Li et al.

(10) Patent No.: US 9,890,934 B2
(45) Date of Patent: Feb. 13, 2018

(54) LED LAMP BEAD WIRE CLAMPING MOUNTING STRUCTURE

(71) Applicant: Dongguan Nabaichuan Electronic Technological Co., Ltd., Dongguan, Guangdong (CN)

(72) Inventors: Degao Li, Guangdong (CN); Zhiyong Li, Guangdong (CN); Wei Wang, Guangdong (CN); Haixin Huang, Guangdong (CN); Feng Zhou, Guangdong (CN)

(73) Assignee: DONGGUAN NABAICHUAN ELECTRONIC TECHNOLOGICAL CO., LTD., Dongguan, Guangdong (CN)

( * ) Notice: Subject to any disclaimer, the term of this patent is extended or adjusted under 35 U.S.C. 154(b) by 111 days.

(21) Appl. No.: 15/004,356

(22) Filed: Jan. 22, 2016

(65) Prior Publication Data

US 2017/0003006 A1 Jan. 5, 2017

(30) Foreign Application Priority Data

Jun. 30, 2015 (CN) ..... 2015 2 0457586 U

(51) Int. Cl.

| | |
|---|---|
| ***F21V 21/14*** | (2006.01) |
| ***F21V 19/00*** | (2006.01) |
| *F21V 19/04* | (2006.01) |
| *F21Y 115/10* | (2016.01) |

(52) U.S. Cl.

CPC ..... *F21V 19/004* (2013.01); *F21V 19/04* (2013.01); *F21Y 2115/10* (2016.08)

(58) Field of Classification Search

CPC ..... F21V 23/06; F21V 21/05; F21V 19/004; H05K 7/1061; H01R 13/629; H01R 12/7076; H01R 13/62; F21Y 2115/10; F12V 19/04

USPC ..... 362/249.06, 396

See application file for complete search history.

(56) References Cited

U.S. PATENT DOCUMENTS

2014/0313723 A1* 10/2014 Tsai ..... F21V 23/06 362/249.06

2016/0372861 A1* 12/2016 Ju ..... H05K 7/1061

* cited by examiner

*Primary Examiner* — Karl D Frech

(74) *Attorney, Agent, or Firm* — Ming Chow; Sinorica, LLC

(57) ABSTRACT

The invention relates to the technical field of Light-Emitting Diodes (LEDs), and in particular to an LED lamp bead wire clamping mounting structure. The LED lamp bead wire clamping mounting structure includes a mounting seat and wire clamping parts, wherein the mounting seat is provided with two accommodation grooves for mounting the wire clamping parts and a mounting groove for mounting an LED lamp bead; the wire clamping parts are arranged in the accommodation grooves; each wire clamping part is provided with a bottom wall, a lamp bead connecting terminal connected with the bottom wall, two sidewalls upwards extending from the bottom wall and a crosswise-folded clamping piece connected with one sidewall; and the crosswise-folded clamping pieces extend to the other sidewalls.

9 Claims, 4 Drawing Sheets

LED LAMP BEAD WIRE CLAMPING MOUNTING STRUCTURE

FIELD OF THE INVENTION

The invention relates to the technical field of Light-Emitting Diodes (LEDs), and in particular to an LED lamp bead wire clamping mounting structure.

BACKGROUND OF THE INVENTION

In existing illumination lamps, a novel solid-state cold light source is adopted for semiconductor illumination, and its light source LED has the remarkable advantages of high efficiency, energy saving, environment friendliness, long service life and the like. Statistics show that power consumption of an LED lamp is only 10 to 20 percent of that of a conventional lamp with the same luminance, and LED lamps are considered as another revolution in the field of illumination, and are also accepted worldwide as green new-generation light sources. Along with people's pursuit of quality of life, the environment protection consciousness of people grows, and particularly some articles for daily use are required to be healthier and more environment-friendly. LED lamps gradually take the place of illumination lamps in other forms.

However, existing LED lamp beads are connected with wires in a welding manner. Generally, positive and negative terminals of a lamp bead are welded on a front surface of an aluminium substrate, the aluminium substrate is welded with a power wire, and such a manner is tedious in welding, more difficult to operate, higher in time consumption and low in welding efficiency; many tools and fixtures are required by welding, which may increase production cost, and under the limitation of an operating space, welding quality is unlikely to be ensured; and when the LED lamp bead is required to be repaired, the LED lamp bead is inconvenient to mount and dismount, and defects are obviously reflected.

SUMMARY OF THE INVENTION

The technical problem to be solved by the invention is to provide an LED lamp bead wire clamping mounting structure, which is compact and small in size. Wire clamping parts are adopted to clamp wires for connecting an LED lamp bead, so that the LED lamp bead wire clamping mounting structure is convenient to connect, mount, dismount, assemble and repair, time is saved, and connection efficiency is improved.

In order to solve the technical problem, the following technical solution is adopted.

An LED lamp bead wire clamping mounting structure includes a mounting seat and wire clamping parts, wherein the mounting seat is provided with two accommodation grooves for mounting the wire clamping parts and a mounting groove for mounting an LED lamp bead; the wire clamping parts are arranged in the accommodation grooves; each wire clamping part is provided with a bottom wall, a lamp bead connecting terminal connected with the bottom wall, two sidewalls upwards extending from the bottom wall and a crosswise-folded clamping piece connected with one sidewall; and the crosswise-folded clamping pieces extend to the other sidewalls.

Preferably, each wire clamping part includes one crosswise-folded clamping piece.

Preferably, each wire clamping part includes two crosswise-folded clamping pieces.

Wherein, the bottom walls are provided with positioning bumps for blocking the crosswise-folded clamping pieces 24.

Wherein, the mounting seat is provided with wire passing grooves, the wire passing grooves being communicated with the accommodation grooves.

Wherein, the mounting seat is provided with nicks for extension of the lamp bead connecting terminals, the nicks being communicated with the accommodation grooves.

Wherein, the LED lamp bead wire clamping mounting structure further includes cover plates, the cover plates being arranged on the accommodation grooves in a covering manner.

Wherein, cover plate platforms are arranged on edges of the accommodation grooves, the cover plate platforms are provided with convex pins, the cover plates are provided with pinholes matched with the convex pins, the cover plates are arranged on the cover plate platforms, and the convex pins are arranged in the pinholes in a penetration manner.

Preferably, each cover plate is provided with six pinholes.

Wherein, wire through grooves are formed in bottoms of the cover plates.

The invention has beneficial effects as follows:

during a practical application, the LED lamp bead is mounted in the mounting groove, and when positive and negative terminals of the LED lamp bead are connected with the wire clamping parts respectively, the lamp bead connecting terminals of the wire clamping parts are attached to the positive and negative terminals of the LED lamp bead; and then external wires are clamped with the wire clamping parts, specifically, the crosswise-folded clamping pieces are inwards pressed by hands to be bounced away from the sidewalls by certain wire clamping spaces, connecting ends of the wires are placed in the wire clamping spaces, and then the crosswise-folded clamping pieces are loosened to be reset, thereby clamping the wires between the crosswise-folded clamping pieces and the sidewalls to further realize the connection of the wires of the LED lamp bead. According to the invention, the wire clamping parts are adopted to clamp the wires of the LED lamp bead, so that the LED lamp bead wire clamping mounting structure is convenient to connect, mount, dismount, assemble and repair, time is saved, and connection efficiency is improved; the wires are prevented from being connected in a welding manner, so that use of tools and fixtures as well as a welding material is avoided, production cost is lowered, energy is saved, and the environment is protected; and in addition, the mounting seat is integrally formed, so that the LED lamp bead wire clamping mounting structure is compact, small in size and high in structural stability and practicability.

DETAILED DESCRIPTION OF THE PREFERRED EMBODIMENTS

Figure 1:
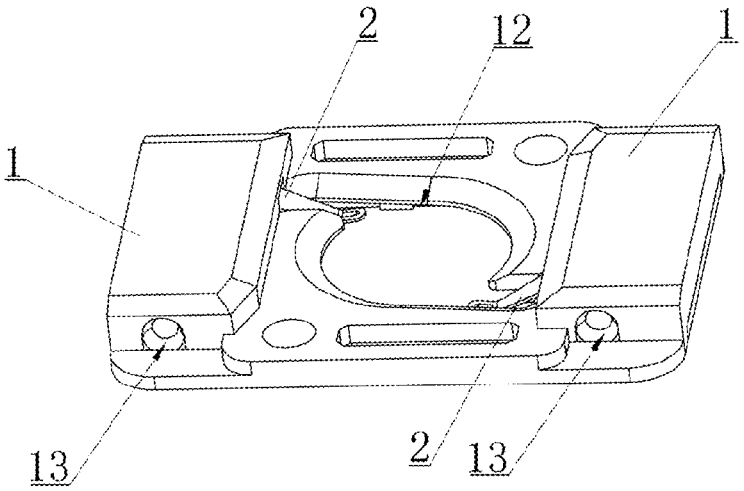
FIG. 1 is a solid structure diagram of embodiment 1 of the invention.
Figure 2:
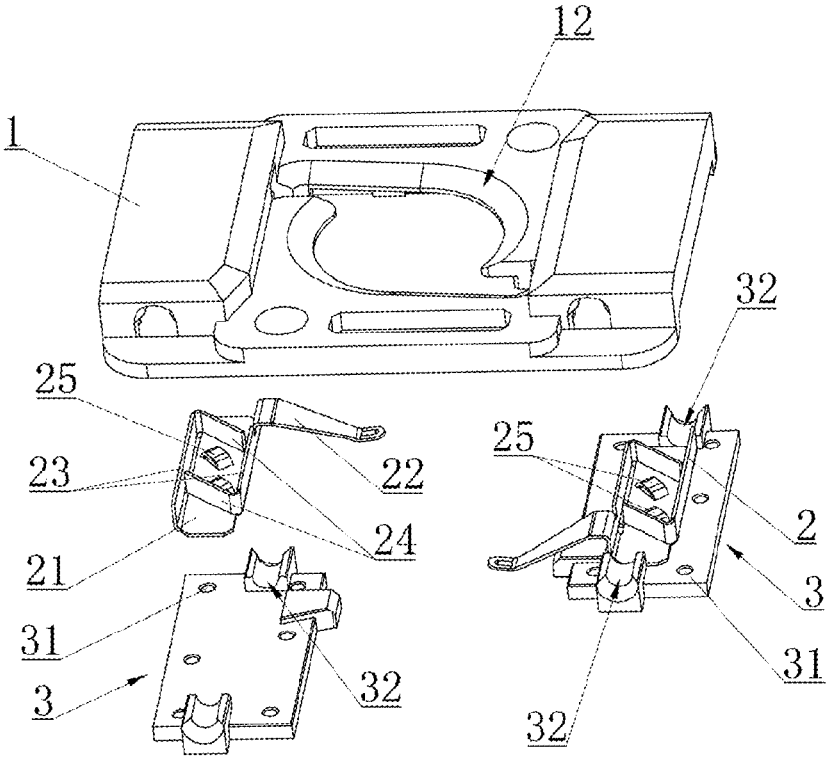
FIG. 2 is a split solid structure diagram of embodiment 1 of the invention.
Figure 3:
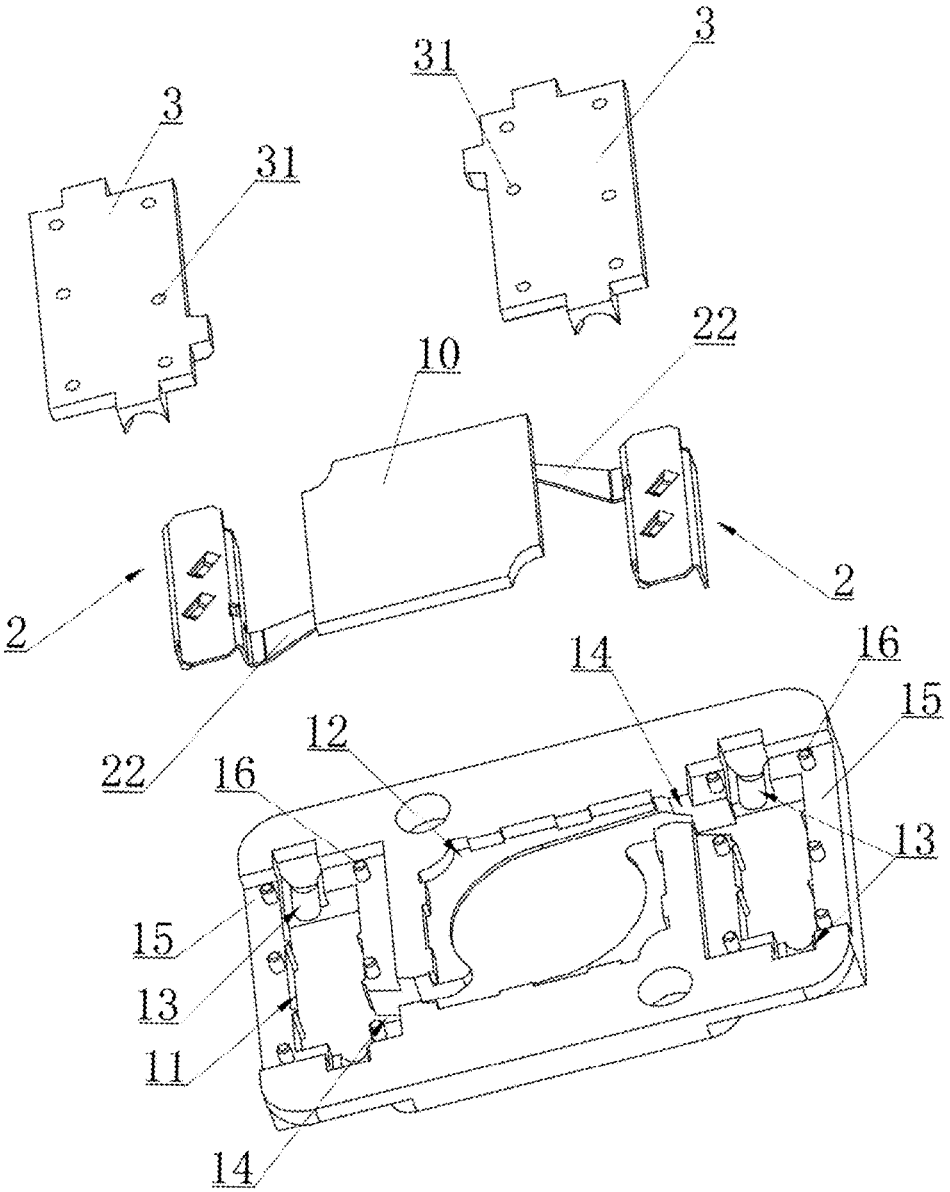
FIG. 3 is another split solid structure diagram of embodiment 1 of the invention.

In order to facilitate understanding of those skilled in the art, the invention is further described below with reference to embodiments and the drawings, and contents involved in implementation modes are not intended to limit the invention.

Embodiment 1

As shown in FIG. 1 to FIG. 5, an LED lamp bead wire clamping mounting structure includes a mounting seat 1 and wire clamping parts 2, wherein the mounting seat 1 is provided with two accommodation grooves 11 for mounting the wire clamping parts 2 and a mounting groove 12 for mounting an LED lamp bead; the wire clamping parts 2 are arranged in the accommodation grooves 11; each wire clamping part 2 is provided with a bottom wall 21, a lamp bead connecting terminal 22 connected with the bottom wall 21, two sidewalls 23 upwards extending from the bottom wall 21 and a crosswise-folded clamping piece 24 connected with one sidewall 23; and the crosswise-folded clamping pieces 24 extend to the other sidewalls 23.

Specifically, the mounting seat 1 is integrally formed from plastics, the wire clamping parts 2 are conductive metal parts, the mounting seat 1 is provided with the two accommodation grooves 11, the wire clamping parts 2 are arranged in the two accommodation grooves 11, and the two wire clamping parts 2 are correspondingly connected with positive and negative terminals of an LED lamp bead 10 to facilitate the connection of the positive and negative terminals of the LED lamp bead 10 respectively.

During a practical application, the LED lamp bead 10 is mounted in the mounting groove 12, and when the positive and negative terminals of the LED lamp bead 10 are connected with the wire clamping parts 2 respectively, the lamp bead connecting terminals 22 of the wire clamping parts 2 are attached to the positive and negative terminals of the LED lamp bead 10; and then external wires are clamped with the wire clamping parts 2, specifically, the crosswise-folded clamping pieces 24 are inwards pressed by hands to be bounced away from the sidewalls 23 by certain wire clamping spaces, connecting ends of the wires are placed in the wire clamping spaces, and then the crosswise-folded clamping pieces 24 are loosened to be reset, thereby clamping the wires between the crosswise-folded clamping pieces 24 and the sidewalls 23 to further realize the connection of the wires of the LED lamp bead 10.

According to the invention, the wire clamping parts 2 are adopted to clamp the wires of the LED lamp bead 10, so that the LED lamp bead wire clamping mounting structure is convenient to connect, mount, dismount, assemble and repair, time is saved, and connection efficiency is improved; the wires are prevented from being connected in a welding manner, so that use of tools and fixtures as well as a welding material is avoided, production cost is lowered, energy is saved, and the environment is protected; and in addition, the mounting seat 1 is integrally formed, so that the LED lamp bead wire clamping mounting structure is compact, small in size and high in structural stability and practicability.

Figure 4:
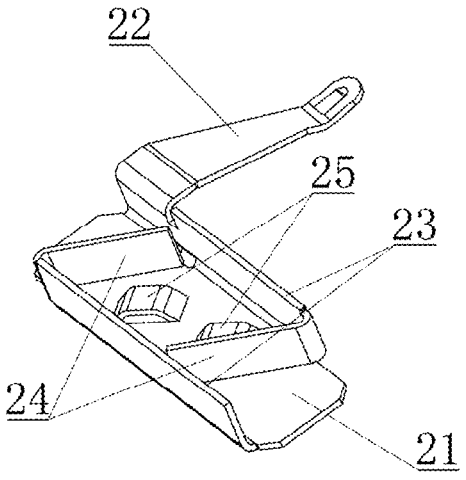
FIG. 4 and FIG. 5 are both solid structure diagrams of a wire clamping part according to embodiment 1 of the invention.
Figure 5:
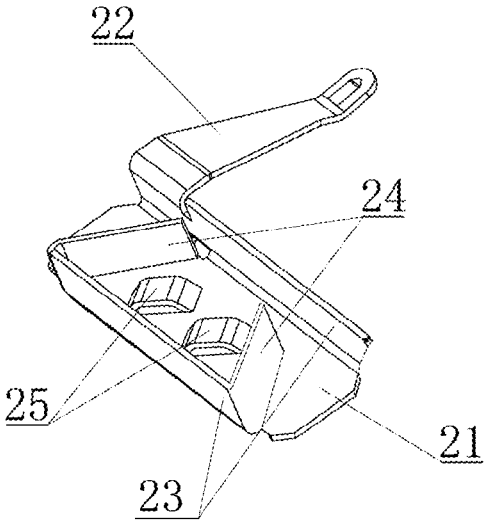

In the embodiment, each wire clamping part includes two crosswise-folded clamping pieces 24. Specifically, as shown in FIG. 4, the two crosswise-folded clamping pieces 24 of each wire clamping part may be arranged on the corresponding two sidewalls 23 respectively; and as shown in FIG. 5, the two crosswise-folded clamping pieces 24 of each wire clamping part may also be arranged on the same sidewall 23. The arrangement of the two crosswise-folded clamping pieces 24 of each wire clamping part means that the same wire clamping part 2 has two wire clamping positions, so that series and parallel connection of the LED lamp bead 10 is facilitated, and the LED lamp bead wire clamping mounting structure is wide in application range and high in practicability.

In the embodiment, the bottom walls 21 are provided with positioning bumps 25 for blocking the crosswise-folded clamping pieces 24, and the positioning bumps 25 are positioned in the spaces formed by the crosswise-folded clamping pieces 24 and the sidewalls 23. When the crosswise-folded clamping pieces 24 are pressed by hands, the positioning bumps 25 block the crosswise-folded clamping pieces 24 to prevent the condition that the crosswise-folded clamping pieces 24 are excessively deformed by excessive force and may not be bounced back, ensure that the crosswise-folded clamping pieces 24 are deformed within a certain range and prolong the service life of the wire clamping parts 2.

In the embodiment, the mounting seat 1 is provided with wire passing grooves 13, and the wire passing grooves 13 are communicated with the accommodation grooves 11. Specifically, the wire passing grooves 13 are formed in front and rear sides of the mounting seat 1 to facilitate the arrangement of the wires. During use, the wires enter the accommodation grooves 11 through the wire passing grooves 13, and are clamped between the crosswise-folded clamping pieces 24 and the sidewalls 23.

In the embodiment, the mounting seat 1 is provided with nicks 14 for extension of the lamp bead connecting terminals 22, and the nicks 14 are communicated with the accommodation grooves 11. The accommodation grooves 11 and the nicks 14 are formed in left and right sides of the mounting seat 1, and the accommodation groove 11 and nick 14 in the right side are designed in a manner of rotating by 180 degrees relative to the accommodation groove 11 and nick 14 in the left side, so that the LED lamp bead wire clamping mounting structure is reasonable in layout, and the wires may be convenient to arrange. During use, the lamp bead connecting terminals 22 extend to the LED lamp bead 10 from the nicks 14, and are attached to the LED lamp bed 10, and the nicks 14 may play a role in fixing the lamp bead connecting terminals 22 to prevent movement of the wire clamping parts 2 and lower a loosening rate of the wires.

In the embodiment, the LED lamp bead wire clamping mounting structure further includes cover plates 3, and the cover plates 3 are arranged on the accommodation grooves 11 in a covering manner. The cover plates 3 are integrally formed from plastics, the cover plates 3 seal the wire clamping parts 2 in the accommodation grooves 11 for fixation, and in addition, the cover plates 3 may insulate the wire clamping parts 2 in an energy-saving manner to ensure safety in use. When the LED lamp bead wire clamping mounting structure is mounted, outer surfaces of the cover plates 3 and a mounting surface of the mounting seat 1 are in the same direction, that is, the outer surfaces of the cover plates 3 and the mounting surface of the mounting seat 1 are in the same plane, so that stability of the wire clamping parts 2 is further ensured.

In the embodiment, cover plate platforms 5 are arranged on edges of the accommodation grooves 11, the cover plate platforms 15 are provided with convex pins 16, the cover plates 3 are provided with pinholes 31 matched with the convex pins 16, the cover plates 3 are arranged on the cover plate platforms 15, and the convex pins 16 are arranged in the pinholes 31 in a penetration manner. During assembling, the pinholes 31 are aligned with the convex pins 16, and then the cover plates 3 are pressed at the cover plate platforms 15.

The LED lamp bead wire clamping mounting structure is convenient to mount and dismount, and may be reliably fixed.

Furthermore, each cover plate is provided with six pinholes 31. Specifically, three are formed in one side of the corresponding cover plate platform 15, and the other three are formed in the other side of the corresponding cover plate platform 15, so that the cover plate 3 may be stably mounted, and is unlikely to be loosened.

In the embodiment, wire through grooves 32 are formed in the bottoms of the cover plates 3. During mounting, the wire through grooves 32 are buckled to the wire passing grooves 13 of the mounting seat 1 to form complete wire through holes, and the wire through holes guide and fix the wires to ensure regular wiring.

Embodiment 2

Figure 6:
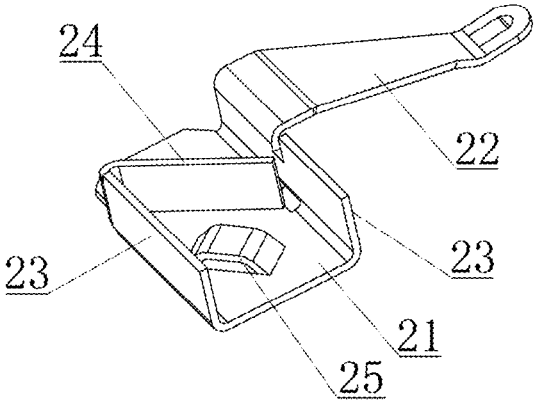
FIG. 6 is a solid structure diagram of a wire clamping part according to embodiment 2 of the invention.

As shown in FIG. 6, a difference between embodiment 2 and embodiment 1 is as follows: each wire clamping part is provided with one crosswise-folded clamping piece 24. Specifically, the same wire clamping part 2 has only one wire clamping position, so that the LED lamp bead wire clamping mounting structure is more compact, small in size and low in production cost, and different market requirements are met.

The embodiments are preferred implementation solutions of the invention, and beyond that, the invention may be implemented in other manners. Any obvious replacements made without departing from the concept of the technical solution shall fall within the scope of protection of the invention.

What is claimed is:

1. An Light-Emitting Diode (LED) lamp bead wire clamping mounting structure comprising:

a mounting seat (1) and wire clamping parts (2);

the mounting seat (1) being provided with two accommodation grooves (11) for mounting the wire clamping parts (2) and a mounting groove (12) for mounting an LED lamp bead;

the wire clamping parts (2) being arranged in the accommodation grooves (11);

each wire clamping part (2) being provided with a bottom wall (21), a lamp bead connecting terminal (22) connected with the bottom wall (21), two sidewalls (23) upwards extending from the bottom wall (21) and a crosswise-folded clamping piece (24) connected with one sidewall (23);

the crosswise-folded clamping pieces (24) extending to the other sidewalls (23);

the mounting seat (1) being provided with nicks (14) for extension of the lamp bead connecting terminals (22); and the nicks (14) being communicated with the accommodation grooves (11).

2. The LED lamp bead wire clamping mounting structure according to claim 1, wherein each wire clamping part comprises one crosswise-folded clamping piece (24).

3. The LED lamp bead wire clamping mounting structure according to claim 1, wherein each wire clamping part comprises two crosswise-folded clamping pieces (24).

4. The LED lamp bead wire clamping mounting structure according to claim 1, wherein the bottom walls (21) are provided with positioning bumps (25) for blocking the crosswise-folded clamping pieces (24).

5. The LED lamp bead wire clamping mounting structure according to claim 1, wherein the mounting seat (1) is provided with wire passing grooves (13), the wire passing grooves (13) being communicated with the accommodation grooves (11).

6. The LED lamp bead wire clamping mounting structure according to claim 1, further comprising cover plates (3), the cover plates (3) being arranged on the accommodation grooves (11) in a covering manner.

7. The LED lamp bead wire clamping mounting structure according to claim 6, wherein cover plate platforms (15) are arranged on edges of the accommodation grooves (11), the cover plate platforms (15) are provided with convex pins (16), the cover plates (3) are provided with pinholes (31) matched with the convex pins (16), the cover plates (3) are arranged on the cover plate platforms (15), and the convex pins (16) are arranged in the pinholes (31) in a penetration manner.

8. The LED lamp bead wire clamping mounting structure according to claim 7, wherein each cover plate is provided with six pinholes (31).

9. The LED lamp bead wire clamping mounting structure according to claim 6, wherein wire through grooves (32) are formed in bottoms of the cover plates (3).

* * * * *